United States Patent [19]

Shirasaki et al.

[11] 4,351,287

[45] Sep. 28, 1982

[54] PROCESS OF CONTROLLING THE CURRENT FLOWING PERIOD OF AN IGNITION COIL

[75] Inventors: Shinji Shirasaki, Kariya; Takashi Yamada, Anjo; Mamoru Shimamoto, Nagoya, all of Japan

[73] Assignee: Nippondenso Co., Ltd., Kariya, Japan

[21] Appl. No.: 175,414

[22] Filed: Aug. 5, 1980

[30] Foreign Application Priority Data

Aug. 6, 1979 [JP] Japan ..... 54/99412

[51] Int. Cl.[3] ..... F02P 1/00

[52] U.S. Cl. ..... 123/609; 123/611; 123/644

[58] Field of Search ..... 123/644, 609, 611

[56] References Cited

U.S. PATENT DOCUMENTS

| | | | |
|---|---|---|---|
| 3,831,571 | 8/1974 | Weber | 123/644 |
| 3,937,193 | 2/1976 | Kim | 123/644 |
| 4,298,941 | 11/1981 | Furuhashi | 123/609 |
| 4,309,973 | 1/1982 | Tamura | 123/609 |

*Primary Examiner*—Ronald B. Cox

*Attorney, Agent, or Firm*—Cushman, Darby & Cushman

[57] ABSTRACT

A system for controlling the primary current of an ignition coil using a constant current signal having a calculation device to produce a signal for controlling the ON period of the primary current of the ignition coil, wherein a correction calculation device is provided to calculate the corrected value of the constant current period of the ignition coil.

5 Claims, 10 Drawing Figures

PROCESS OF CONTROLLING THE CURRENT FLOWING PERIOD OF AN IGNITION COIL

TECHNICAL FIELD

The present invention relates to a process of controlling the current flowing period of an ignition coil for an internal combustion engine.

BACKGROUND ART

A system for controlling the primary current of an ignition coil using a constant current signal is illustrated in FIG. 1. This system comprises a rotation sensor 1 for sensing the rate of rotation of an engine, a variables sensor 2 for sensing variables other than the rate of rotation of the engine, a calculation circuit 3 for calculating the current flowing period from the data supplied from the rotation sensor 1, the variables sensor 2 and an igniter circuit 4, an igniter circuit 4, an ignition coil 5, a distributor 6, and a spark plug 7.

The changes in the primary current of the ignition coil are illustrated in FIGS. 2 and 3. The wave forms of the signal $T_{on}$ for controlling on-off state of the primary current $I_1$ of an ignition coil, the signal $S_c$ detecting the constant current value of the primary current $I_1$ of an ignition coil and the primary current $I_1$ itself are illustrated in FIGS. 2 and 3. In the case of FIG. 2 where a sufficient OFF time, such as 5 msec, of the primary current is maintained so as to enable a complete discharge of the stored energy in the ignition coil, the delay $t_2$ of the moment of turn-on in the wave form $S_c$ corresponding to the delay $t_1$ of the moment of turn-on in the wave form $T_{on}$ is equal to the delay $t_1$, i.e. $t_1=t_2$.

Contrary to the above, in the case of FIG. 3 where sufficient OFF time of the primary current is not maintained so as to leave some amount of energy stored in the ignition coil, the delay $t_4$ of the moment of turn-on in the wave form $S_c$ corresponding to the delay $t_3$ of the moment of turn-on in the wave form $T_{on}$ is greater than $t_3$, i.e. $t_4>t_3$. This is because the primary current $I_1$ jumps by the value J the moment the primary current starts to flow because of the release of the remaining energy of the ignition coil.

An example of prior art system for controlling the primary current of an ignition coil using a constant current signal is illustrated in FIG. 4. A present constant current time $T_e$ is calculated in the routine 31'. An actual constant current time $T_a$ in the preceding ignition cycle is supplied from the routine 32'. A predetermined OFF angle, for example, 45° C.A. for a four cylinder four cycle engine, which claims priority is maintained by the routine 37'. A signal $T_{on}$ for controlling the present ignition cycle is produced from the routine 37'. A signal of ON time for the preceding ignition cycle $T_{on.prec}$ is obtained at the output 10' of the routine 35'.

The difference between $t_e$ and $T_a$ is calculated in the routine 33' to produce a difference value "$T_e-T_a$" at the output 9' of the routine 33'. A value $T_{on.prec}$, which is an ON time for the preceding ignition cycle, is added to the difference value "$T_e-T_a$" by the routine 36' to produce a signal, which represents an ON time for the present ignition cycle, at the output 11', After maintaining with priority a predetermined OFF angle by the routine 37', a signal $T_{on}$ for controlling the present ignition cycle is obtained at the output of the routine 37'.

However, the system of FIG. 4 has a disadvantage that, when the voltage of the power source which supplies power to the primary winding of the ignition coil is reduced, an extended time is required to attain the state of constant current, and hence, the ON time of the primary current of the ignition coil is increased. In this case, if the speed of rotation of the engine is increased, sufficient energy for effecting ignition is not obtained because of the maintenance of the priority claiming OFF angle.

Another example of a prior art system for controlling the primary current of an ignition coil using a constant current signal is illustrated in FIG. 5. The system of FIG. 5 is the same as the system of FIG. 4, except that a routine 38' for maintaining with priority a predetermined OFF period replaces the routine 37' of FIG. 4 for maintaining with priority a predetermined OFF angle. The routine 38' ensures an OFF period which is the period from a sparking to the next start of the primary current of the ignition coil. The system of FIG. 5 has an advantage over the system of FIG. 4, because the OFF period does not depend upon the speed of rotation of the engine, and hence, no such disadvantage as described above is involved. The OFF period is selected to be, for example, 0.6 to 0.7 msec.

However, the primary current of the ignition coil $I_1$ jumps by a value J at the end of the OFF period, and hence, the constant current period is extended by a value $t_4$, as illustrated in FIG. 3. This extension of the constant current period is disadvantageous because the gain of the control loop of the system of FIG. 5 becomes greater than unity, which causes an occurrence of oscillation in the control loop.

The present invention is directed to eliminating the above described disadvantages in the prior art systems.

SUMMARY OF THE INVENTION

It is the main object of the invention to provide a process of controlling the current flowing period of an ignition coil in an ignition system by which an occurrence of oscillation in the control loop is prevented, the control with high response speed is ensured even when a variation in the speed of rotation of the engine occurs and sufficient energy for effecting ignition is supplied to the spark plug without increasing heat generation in the igniter circuit and the ignition coil.

In accordance with the present invention, there is provided a process of controlling the current flowing period of an ignition coil in an ignition system of an internal combustion engine, which system includes a rotation sensor for sensing the rotation of the engine, a variables sensor for sensing variables other than the rate of rotation of the engine, a calculation device for calculating the current flowing period from the data supplied from said rotation sensor, said variables sensor and an igniter circuit, an igniter circuit for amplifying the output signal of said calculation device to energize an ignition coil and, when the value of the primary current of said ignition coil becomes a predetermined value, to produce a constant current signal, an ignition coil energized by said igniter circuit and a spark plug, wherein said process is characterized in that it comprises the steps of:

calculating a command of the constant current period of said ignition coil;

comparing said command with a measured value of the constant current period of said ignition coil for the preceding ignition cycle;

calculating a correction value of the constant current period of said ignition coil for the present ignition cycle;

obtaining a corrected value of the constant current period of said ignition coil for the present ignition cycle, and;

maintaining with priority a predetermined OFF period of the primary current of said ignition coil.

DESCRIPTION OF THE PREFERRED EMBODIMENTS

Figure 6:
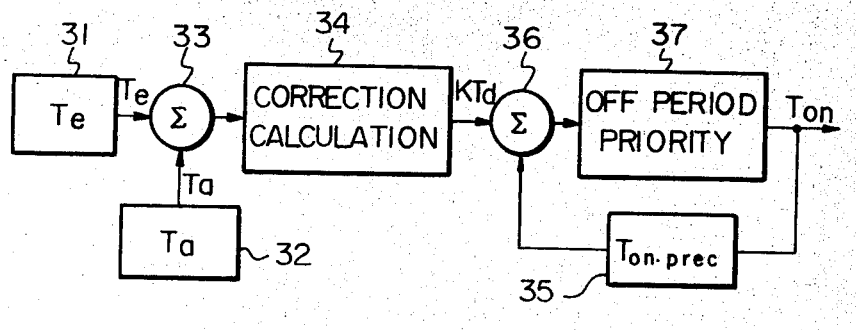
FIG. 6 illustrates a process of controlling the current flowing period of an ignition coil in accordance with an embodiment of the present invention.

A process of controlling the current flowing period of an ignition coil for an internal combustion engine in accordance with an embodiment of the present invention is illustrated in FIG. 6. The process of FIG. 6 is applied to the system of FIG. 1 for controlling the primary current of an ignition coil using a constant current signal. The calculation circuit 3, in accordance with the present invention, comprises a routine 31 for calculating a preset constant current time $T_e$, a routine 32 for supplying an actual constant current time in the preceding ignition cycle $T_a$, a summation routine 33, a corrective calculation circuit 34, a summation routine 36, a routine 37 for maintaining with priority a predetermined OFF period and a routine 35 for supplying a signal of ON time for the preceding ignition cycle.

Upon receipt of the signal $T_d$, which is the difference "$T_e - T_a$" between the preset constant current time $T_e$ and the actual constant current time $T_a$ in the preceding ignition cycle, the corrective calculation circuit 34 calculates a correction value $KT_d$ for the constant current time. This value $KT_d$ is added to the value of the ON period $T_{on.prec}$ for the preceding ignition cycle by the summation circuit 36, to produce a signal for the present ignition cycle which is supplied to the routine 37 for maintaining with priority a predetermined OFF period. Thus a signal $T_{on}$ for the present ignition cycle is obtained at the output of the routine 37.

Figure 7:
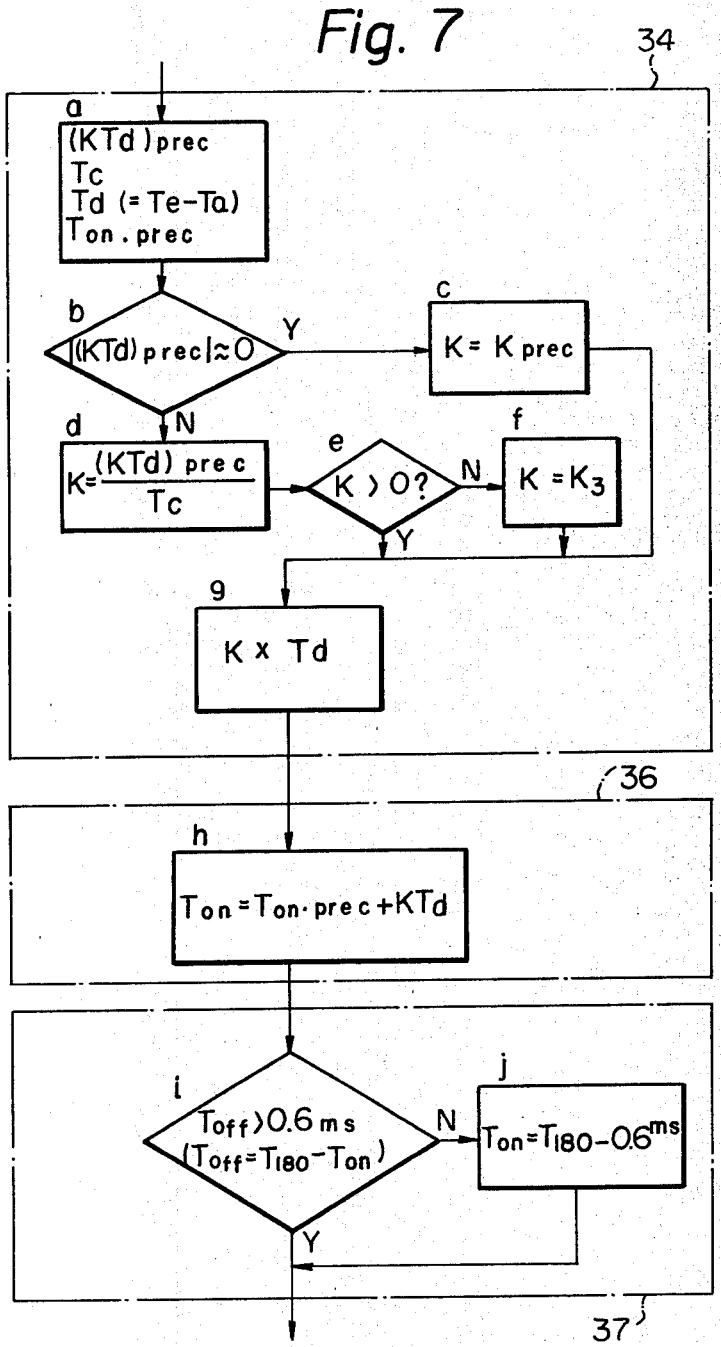
FIG. 7 illustrates a logic flow chart of the process carried out in the system of FIG. 6.

An example of the process carried out in the system of FIG. 6 will now be explained with reference to a logic flow chart of FIG. 7. The calculated correction value $(KT_d)_{prec}$ for the constant current time in the preceding ignition cycle, the measured correction value $T_c$ for the constant current time in the preceding ignition cycle, the difference value $T_d$ between $T_e$ and $T_a$ and the ON period $T_{on.prec}$ for the preceding ignition cycle are provided in the step a. The determination as to whether or not $(KT_d)_{prec}$ is approximately equal to zero is effected in the step b. If this judgement is Y (yes), the value $K_{prec}$ for the preceding ignition cycle is sent from the step c to the step i. While, if this judgement is N (no), the value K which is the quotient of the division of $(KT_d)_{prec}$ by $T_c$ is calculated in the step d. In accordance with the determination in the step e, the value K is supplied to the step g when K is greater than zero, while the predetermined value $K_3$, which is approximately between 3 and 5, is supplied to the step g when K is not greater than zero. The result of the step g, in which the value $T_d$ is multiplied by K, is supplied to the step h, where the $KT_d$ is added to the ON period $T_{on.prec}$ for the preceding ignition cycle. In the step i the value $T_{off}$, which is equal to $T_{180}$ minus $T_{on}$, is compared with a predetermined value of, for example, 0.6 msec. If the value $T_{off}$ is greater than 0.6 msec, the value $T_{on}$ supplied from the step h is produced as the control signal, while if the value $T_{off}$ is not greater than 0.6 msec, the value $T_{on}$ which is equal to $T_{180}$ minus 0.6 msec is produced as the control signal. $T_{180}$ corresponds to the period of one ignition cycle.

Figure 1:
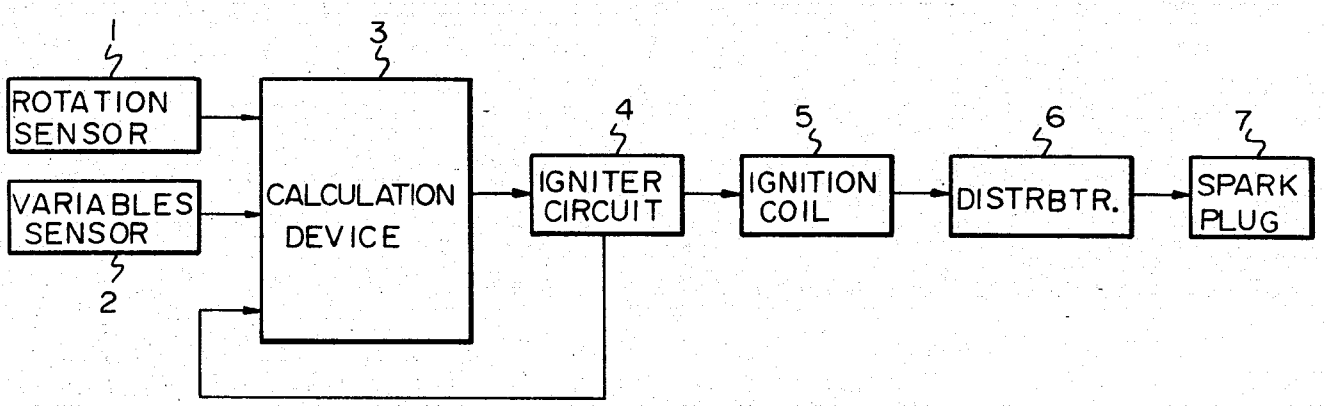
FIG. 1 illustrates a system for controlling the primary current of an ignition coil using a constant current signal to which the present invention is to be applied.
Figure 2:
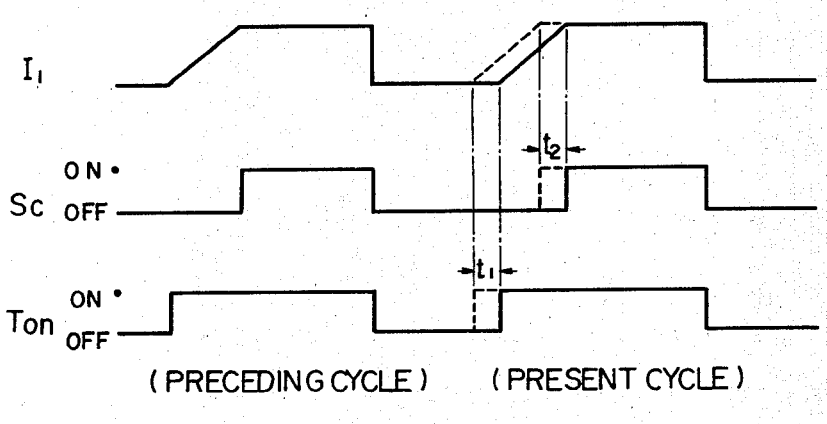
FIGS. 2 and 3 illustrate the changes in the primary current of the ignition coil in the system of FIG. 1.
Figure 3:
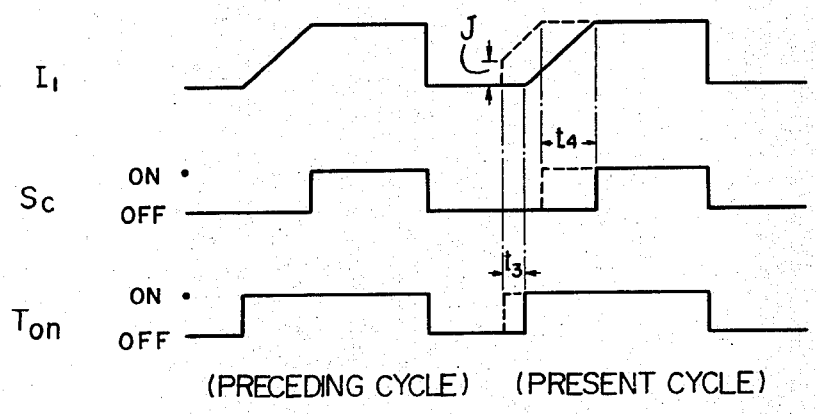
Figure 4:
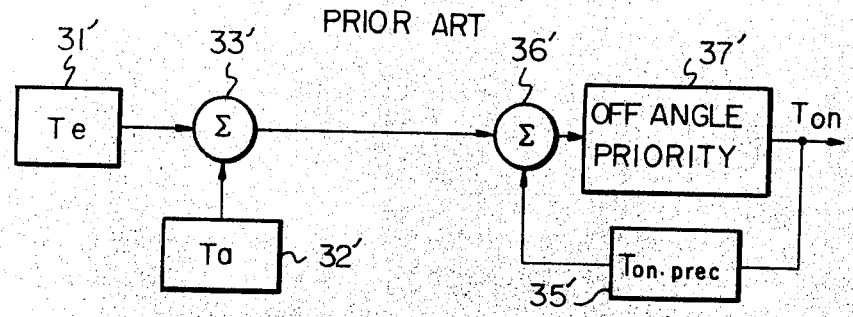
Fig. 4 PRIOR ART
FIGS. 4 and 5 illustrate prior art systems for controlling the primary current of an ignition coil using a constant current signal.
Figure 5:
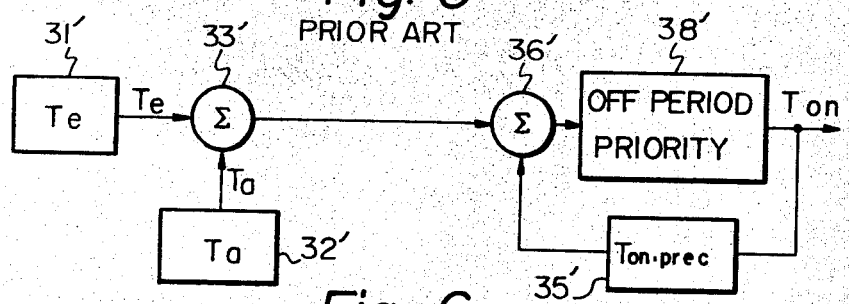
Fig. 5 PRIOR ART
Figure 8:
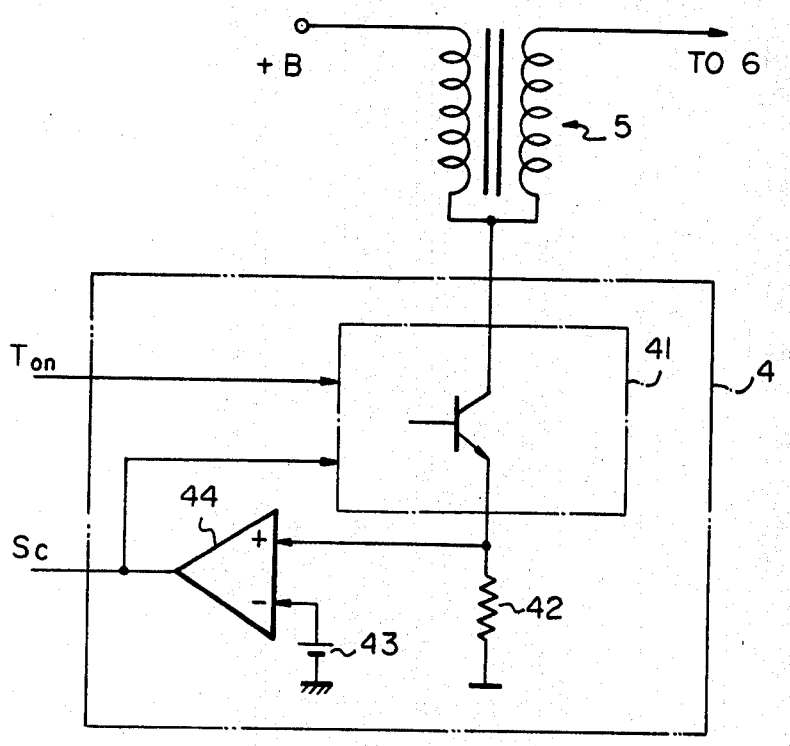
FIG. 8 illustrates the circuits of the igniter and the ignition coil of the system of FIG. 1.

The circuits of the igniter circuit 4 and the ignition coil 5 of the system of FIG. 1 are illustrated in FIG. 8. The primary winding of an ignition coil 5 is connected to a power amplification circuit 41, which is connected to a resistor 42 for detecting the primary current of the ignition coil 5. A comparator 44 is provided in the igniter circuit 4 which compares the voltage across the resistor 42 with a reference voltage 43 to produce a constant current signal $S_c$ when the voltage across the resistor 42 exceeds the reference voltage 43. The power amplification circuit 41 is controlled by both the signal $T_{on}$ supplied from the calculation circuit 3 and the signal $S_c$ supplied from the comparator 44. In accordance with the signal $T_{on}$ and the signal $S_c$, on-off control of the primary current of the ignition coil 5 is effected.

Figure 9:
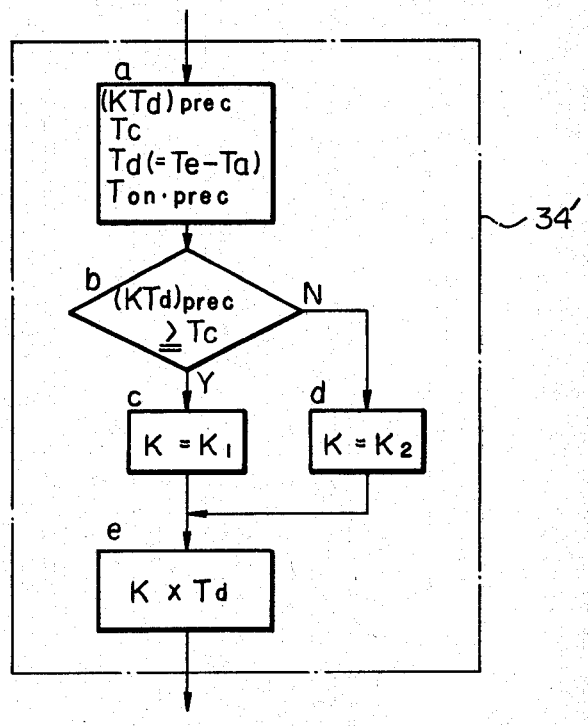
FIGS. 9 and 10 illustrate modified logic flow charts of the process carried out in the system of FIG. 6.

Another example of the process carried out in the system of FIG. 6 will now be explained with reference to a logic flow chart of FIG. 9. The correction value of the constant current period for the preceding ignition cycle $(KT_d)_{prec}$ is compared with the measured value of the constant current period $T_c$ in the step b. When $(KT_d)_{prec}$ is smaller than $T_c$, the value $K_2$ is selected for K in the step d and supplied to the step e, while, when $(KT_d)_{prec}$ is either equal to or greater than $T_c$, the value $K_1$ is selected for K in the step c and supplied to the step e. The step d corresponds to the case where a jump of the primary current of the ignition coil occurs. Each of $K_1$ and $K_2$ is a value that makes the gain of the control loop of FIG. 6 either equal to or smaller than unity. $K_1$ is a velue between $K_2$ and unity, i.e. $K_2 < K_1 \leqq 1$.

Figure 10:
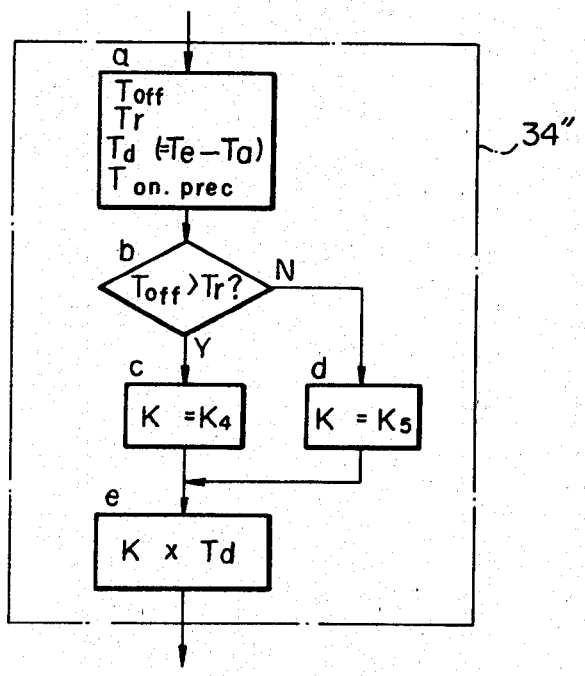

Still another example of the process carried out in the system of FIG. 6 will now be explained with reference to a logic flow chart of FIG. 10. A calculated OFF period of the primary current of the ignition coil $T_{off}$ is compared with an experimentally obtained ignition arc duration period $T_r$ which corresponds to an occurrence of a jump of the primary current of the ignition coil in the step b. When $T_r$ is either equal to or greater than $T_{off}$, the value $K_5$ is selected in the step d and supplied to the step e, while, when $T_r$ is smaller than $T_{off}$, the value $K_4$ is selected for K in the step c and supplied to the step e. For example, $K_4$ is the same as $K_1$ in FIG. 9 and $K_5$ is the same as $K_2$ in FIG. 9.

We claim:

1. A process of controlling the current flowing period of an ignition coil in an ignition system of an internal combustion engine which system includes a rotation sensor for sensing the rotation of the engine, a variables sensor for sensing variables other than the rate of rotation of the engine, a calculation device for calculating the current flowing period from the data supplied from said rotation sensor, said variables sensor and an igniter circuit, an igniter circuit for amplifying the output signal of said calculation device to energize an ignition coil and, when the value of the primary current of said ignition coil becomes a predetermined value, to produce a constant current signal, an ignition coil energized by said igniter circuit and a spark plug, characterized in that said process comprises the steps of:

calculating a command of the constant current period of said ignition coil;

comparing said command with a measured value of the constant current period of said ignition coil for the preceding ignition cycle;

calculating a correction value of the constant current period of said ignition coil for the present ignition cycle;

obtaining a corrected value of the constant current period of said ignition coil for the present ignition cycle, and;

maintaining with priority a predetermined OFF period of the primary current of said ignition coil.

2. A process as defined in claim 1, wherein said calculation of a correction value is effected by multiplying the difference between a command of the constant current period and a measured value of the constant current period for the preceding ignition cycle by a ratio determined by a comparison between a calculated value of the constant current period for the preceding ignition cycle and the measured value of the constant current period for the preceding ignition cycle.

3. A process as defined in claim 1, wherein said calculation of a correction value is effected by multiplying the difference between a command of the constant current period and a measured value of the constant current period for the preceding ignition cycle by a correction coefficient determined by a comparison between a calculated correction value of the current flowing period for the preceding ignition cycle and a measured correction value of the constant current period.

4. A process as defined in claim 1, wherein said calculation of a correction value is effected by multiplying the difference between a command value of the constant current period and a measured value of the constant current period for the preceding ignition cycle by a correction coefficient determined by a comparison between the OFF period of the current of the ignition coil and an experimentally obtained ignition arc duration period.

5. A process as defined in claim 1, wherein said calculation of a correction value is effected by multiplying the difference between an aimed value of the constant current period and a measured value of the constant current period for the preceding ignition cycle by a correction coefficient determined by detection of a jump of the primary current of the ignition coil by a jump detector.

* * * * *